United States Patent [19]

Iwama

[11] Patent Number: 4,991,320

[45] Date of Patent: Feb. 12, 1991

[54] FORWARD PRESSURE EXERTING SKI BOOTS

[75] Inventor: Shinichi Iwama, Tokyo, Japan

[73] Assignee: Daiwa Seiko, Inc., Tokyo, Japan

[21] Appl. No.: 559,508

[22] Filed: Jul. 23, 1990

Related U.S. Application Data

[63] Continuation of Ser. No. 377,471, Jul. 10, 1989, abandoned.

[51] Int. Cl.[5] ..... A43B 5/04

[52] U.S. Cl. ..... 36/119; 36/120; 36/121

[58] Field of Search ..... 36/50, 117, 118, 119, 36/120, 121

[56] References Cited

U.S. PATENT DOCUMENTS

| | | | |
|---|---|---|---|
| 4,577,420 | 3/1986 | Petrini et al. | 36/117 |
| 4,653,205 | 3/1987 | Kock | 36/117 |
| 4,693,020 | 9/1987 | Salas et al. | 36/117 |
| 4,694,593 | 9/1987 | Petrini et al. | 36/120 |
| 4,769,930 | 9/1988 | Morell et al. | 36/117 |

FOREIGN PATENT DOCUMENTS

| | | | |
|---|---|---|---|
| 2709694 | 3/1977 | Fed. Rep. of Germany | 36/119 |

OTHER PUBLICATIONS

Ski Magazine, Mar.-Apr. 1988, p. 92, French Ed., No. 85.

Salomon Cat. 89/90, France ©1/1989, pp. 2-9, 14, 15, 54.

*Primary Examiner*—Paul T. Sewell
*Assistant Examiner*—M. D. Patterson
*Attorney, Agent, or Firm*—Kalish & Gilster

[57] ABSTRACT

The present invention relates to ski boots which can keep appropriate forward tilt pressure, wherein when the boots are tilted forwardly an alastic section is pressed toward the toe side by a mating part which is formed in a front cuff, therefore this elastic restoring force of the elastic section can generate an appropriate elastic force.

4 Claims, 3 Drawing Sheets

FORWARD PRESSURE EXERTING SKI BOOTS

This is a continuation of abandoned application Ser. No. 07/377,471 filed July 10, 1989, now abandoned.

BACKGROUND OF THE INVENTION

The present invention relates to ski boots, and particularly to ski boots capable of keeping an appropriate pressure to hold feet in a forwardly tilted form.

Generally, ski boots are formed to be able to tilt feet forward without hurting feet while receiving an appropriate resiliency so as to properly correspond to any stress applied during skiing such as bending and stretching, weight shifting, and walking.

Such ski boots known include those as disclosed in for example Japanese Patent Application Laid-open Print No. 59-225001.

The ski boot disclosed in the above laid-open print is formed by being provided with an oblong hole with a certain width from the side end of an instep of a front cuff which overlaps with the outside of a shell body to form an instep side front cuff and a shin side front cuff, an elastic section on a part connecting the instep side front cuff and the shin side front cuff to generate elastic force when a forwardly tilted posture is taken, and an elastic force-suppressing member for suppressing the elastic force of the elastic section as slidably fitted in the oblong hole.

In these ski boots, the elastic force-suppressing member is fitted in an appropriate position of the oblong hole and when the boots are forwardly tilted, and the shin side front cuff is tilted so as to narrow the oblong hole of the front cuff to generate a suitable elastic force in the elastic section, thereby capable of providing a forward tilt pressure depending on the skills of the skier.

These conventional ski boots have the oblong hole formed in the front cuff which overlaps with the outside of the shell body. That is, the oblong hole is formed in the outer surface of the ski boots, and snow or foreign substance such as soil and sand contained in snow enters through the oblong hole onto the sliding face between the shin side front cuff and the shell body to vary frictional resistance therebetween and to vary the elastic force. This may result in varying the forward tilt pressure. In this case, there is a problem that a proper control of the ski can not be done.

SUMMARY OF THE INVENTION

An object of this invention is to provide ski boots capable of keeping an appropriate pressure to hold feet in a forwardly tilted form.

Another object of this invention is to provide ski boots which can prevent a forward tilt pressure from varying caused by entering snow or foreign substance such as soil and sand contained in snow.

An additional object of this invention is to provide ski boots which can adjust a forward tilt pressure easily depending on the skills of the skier.

The ski boots of this invention are formed by being provided with an inner boot fitted to an outer shell and its inside, a front cuff mounted capable of tilting forwardly on the shell body, and a rear cuff which is mounted capable of opening backward on the shell body, wherein an elastic force generator is installed on the shell body and an instep part of the front cuff so as to set an appropriate forward tilt pressure against the skier's foot at the ankle part of ski boots including said front cuff and said rear cuff.

In this invention, when the boots are forwardly tilted, an elastic section is pressed toward the toe side by a mating part formed in a front cuff, therefore the elastic restoring force of the elastic section can generate an appropriate elastic force.

DESCRIPTION OF THE PREFERRED EMBODIMENT

Figure 1:
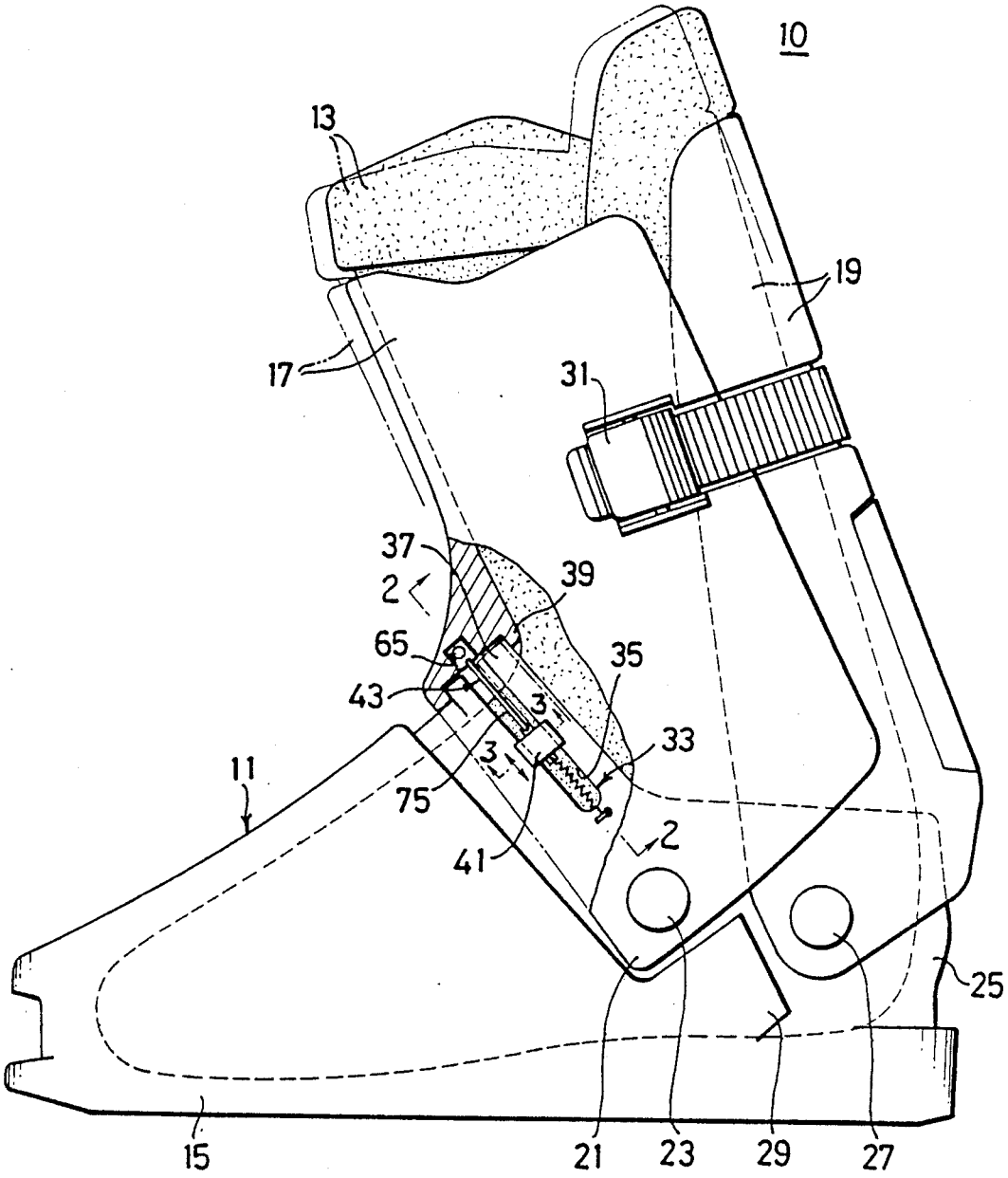
FIG. 1 is a partial cutaway side view showing an embodiment of ski boots of the present invention.

The details of the invention will be described with reference to one embodiment shown in the drawings.

FIG. 1 is a partial cutaway side view showing an embodiment of ski boots of the present invention. In general, a ski boot with reference numeral 10 is formed by being provided with an outer shell 11 which is made of synthetic resin rich in hardness and toughness and an inner boot 13 which is fitted in the outer shell 11.

The outer shell 11 consists of a shell body 15 covering mainly the lower part from an ankle downward, a front cuff 17 covering from an ankle to a shin, and a rear cuff 19 covering from the upper part of a heel to a calf.

The lower end of the front cuff 17 which forms the shell body 15 is pivotably attached capable of tilting forwardly to the inside and outside of an ankle part 21 with a pin 23, while the lower end of the rear cuff 19 is pivotably attached capable of opening backward to a heel covering part 25 of the shell body 15 with a pin 27.

A stopper 29 is formed on the shell body 15 to control the backward tilt movement of the front cuff 17.

Furthermore the front cuff 17 has an ankle tightener 31 to tighten and unite the front and rear cuffs 17 and 19.

And an elastic force generator 33 is installed on the instep part of the shell body 15 and front cuff 17 to set an appropriate pressure to hold skier's foot in a forwardly tilted form at the ankle part of the ski boots including the front cuff 17 and the rear cuff 19.

The elastic force generator 33 consists of an oblong hole 35 disposed at the ankle end part of the shell body 15 and is overlapped by the inside of the front cuff 17 from the inside to outside of the instep part of the shell body 15, an elastic section 37 formed at the ankle end of the shell body 15 defines oblong hole 35 therebetween, and a prominent mating part 39 formed inside the center instep part of the front cuff 17, which mates with the elastic section 37 to press toward the toe end of boot 10.

Elastic force-suppressing members 41 are engaged with the inner and outer ends of the oblong hole 35 in the instep part. The front cuff 17 has an elastic force-adjusting system 43 to adjust an elastic force at the elastic section by sliding the elastic force suppressing member 41 in the longitudinal direction within oblong hole 35.

Figure 2:
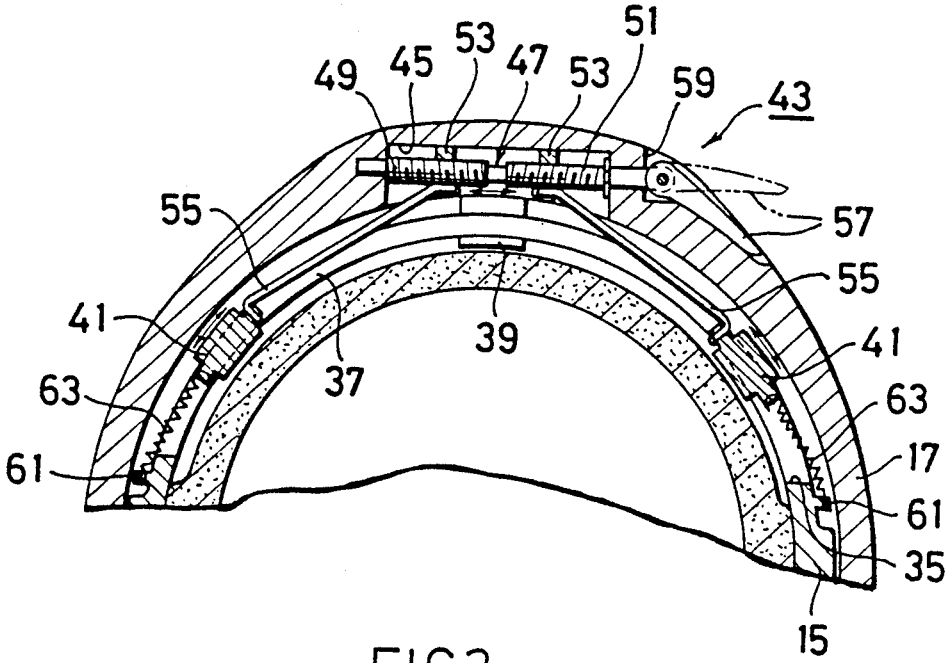
FIG. 2 is a transverse sectional view taken on line II—II of FIG. 1.

The elastic force-adjusting system 43, as shown in FIG. 2, is formed by being provided with a bolt 47 which is accommodated with its both ends connected so as to be freely turnable in a concave 45 formed inside the center instep part of the front cuff 17, two nuts 53 which are connected to right and left threads 49 and 51 formed respectively at both ends of said bolt 47 to be fitted by detent in the concave area 45 of the front cuff 17, and a traction rod member 55 which couples these nuts 53 with two elastic force-suppressing members 41 respectively.

One end of the bolt 47 is extended to penetrate the front cuff 17. An adjusting lever 57 is installed capable of turning freely at the end of the bolt 47 penetrated through the front cuff 17. The adjusting lever 57 is folded to be housed in a lever housing concave area 59 formed in the outer surface of the front cuff 17 so as not to project outside.

The shell body 15 in the longitudinal direction of the oblong hole 35 encloses a convex member 61, which is connected to the elastic force-suppressing member 41 with a spring 63 which moves the elastic force-suppressing member 41 in the longitudinal direction of the oblong hole 35.

Figure 3:
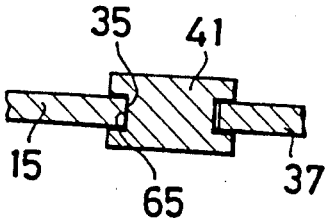
FIG. 3 is a transverse sectional view taken on line III—III of an elastic force-suppressing member of FIG. 1.

The elastic force-suppressing member 41, as shown in FIG. 3, is formed to have an H-shaped transverse section and has two concave portions 65. These concave portions 65 are fitted to the shell body 15 on both sides of the oblong hole 35 and the elastic section 37 so that the elastic force-suppressing member 41 is not separated from the oblong hole 35 even if the ski boot 10 is shocked or the elastic force-suppressing member 41 slides in the oblong hole 35.

In the ski boot 10 formed as mentioned above, the adjusting lever 57 is pulled out of the lever housing concave 59 as shown by a two-dot and line in FIG. 2 and turned to move the nuts 53 connected by detent to the bolt 47 right and left, thereby pulling the elastic force-suppressing members 41 which are connected to the nuts 53 to be able to obtain an appropriate elastic force and sliding within the oblong hole 35, which may adjust the position of the elastic force-suppressing members 41 easily from outside the front cuff 17 by using the adjusting lever 57.

For example, in the ski boots 10 for a beginning skier to attach importance to the safety when skiing, the adjusting lever 57 is used to turn the bolt 47 so as to separate the two nuts 53 to separate away the two elastic force-suppressing members 41 respectively to the both ends of the oblong hole 35 to widen a distance between the two elastic force-suppressing members 41, thereby capable of bending easily, which may make an elastic force larger and a forward tilt pressure smaller so as to be able to hold the skier's foot not too tight. That is, when supposing that the elastic section 37 between the two elastic force-suppressing members 41 is a kind of a bridge whose fulcrum are the two elastic force-suppressing members 41, the span of the elastic section 37 becomes long and when it is pressed by the mating part 39 which is formed inside of the front cuff 17 (FIG. 2), it becomes to be very bendable.

Figure 4:
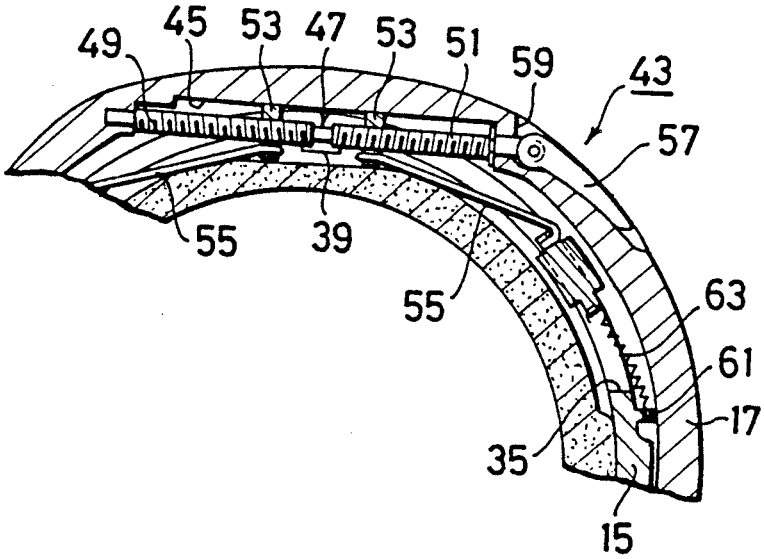
FIG. 4 is an enlarged view of FIG. 2 showing an elastic force-suppressing member adjusted for skilled skiers.

In the ski boots 10 for a skilled skier, to attach importance to easy controlling when skiing, the adjusting lever 57 is used to turn the bolt 47 so as to put the two nuts 53 close to move the two elastic force-suppressing members 41 near to the mating part 39 of the front cuff 17, as shown in FIG. 4, to narrow a distance between the two elastic force-suppressing members 41, thereby making the elastic section difficult to bend easily, so that an elastic force is limited and tilting pressure becomes larger to be able to hold the skier's foot tightly. That is, the elastic section 37 between the two elastic force-suppressing members 41 is a kind of a bridge whose fulcrum is the two elastic force-suppressing members 41, in the case of pressing by the mating part 39 which is formed inside of the ankle end of front cuff 17, its span becomes shorter, so that the elastic section is very difficult to bend.

In the ski boots 10 formed as mentioned above, when the boots are forwardly tilted, as shown by a two-dot and line in FIG. 1, the elastic section 37 is pressed toward the toe end of boot 10 by the mating part 39, therefore this elastic restoring force of the elastic section 37 can generate an appropriate elastic force therein, which may provide an appropriate pressure to hold feet in a forwardly tilted form depending on the skiers' skills and make ski controlling easier.

And the position of the elastic force-suppressing member 41 can be adjusted easily by using the adjusting lever 57 to get an appropriate pressure to hold feet in a forwardly tilted form depending on the skiers' skills.

Furthermore, the oblong hole 35 formed in the shell body 15 is covered with the ankle end of front cuff 17 so as to avoid entrance of snow or foreign substance such as soil and sand contained in snow and varying the forward tilt pressure by preventing the change of elastic force at the elastic force section, and conversely speaking, an appropriate forward tilt pressure can be maintained.

The above embodiment shows examples that the oblong hole 35 is formed from the inside to outside of the instep part of the shell body 15, the two elastic force-suppressing members 41 are fitted to the inside and outside of the instep part of the oblong hole 35, and the elastic section 37 is pressed by the mating part 39 of the front cuff 17. This invention, however, is not defined by the above embodiment and can provide the same effect as the above embodiment even if one elastic force-suppressing member 41 is fitted to the inside or outside of the instep part of the oblong hole 35, and the elastic section 37 is pressed by the mating part 39 of the front cuff 17. In this case, handling the adjusting lever 57 can be improved more easily by forming the oblong hole 35 outside the instep part of the shell body 15 and forming the adjusting lever 57 outside the instep part of the front cuff 17.

Figure 5:
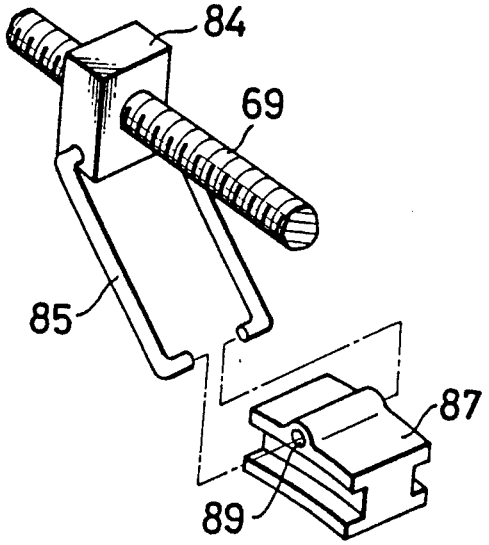
FIG. 5 is an exploded perspective view showing another traction member to draw an elastic force-suppressing member.

And, the above embodiment shows an example that the two nuts 53 fitted by detent to the bolt 47 is coupled to the elastic force-suppressing members 41 with a rod traction member 55. This invention, however, is not limited to the above embodiment and can provide the same effect as above even if the traction member 85 in the shape of ] is installed capable of turning freely, and the both ends of the traction member 85 is connected capable of turning freely in the set hole 89 formed in the elastic force-suppressing member 87 as shown in FIG. 5. And also its simple construction makes manufacturing easy. Furthermore the elastic force-suppressing member 87 can be slid smoothly without moving by a spring as above.

What is claimed is:

1. Ski boots comprising an outer shell and an inner boot fitted into the outer shell and said outer shell being formed of a shell body, a front cuff which is mounted to the shell body to be tiltable forwardly and a rear cuff which is mounted to the shell body to be openable backwardly, wherein an elastic force generator is installed over an instep portion of the shell body and beneath an instep part of the front cuff to set an appropriate pressure to hold a skier's leg in a forwardly tilted form at an ankle part of the ski boots including said front and rear cuffs; said elastic force generator having an oblong hole disposed on the instep portion of said shell body where the elastic force generator is overlapped by the inside of said front cuff instep part, thereby providing an elastic section on the instep portion of said shell body, defining said oblong hole therebetween and forming in the front cuff a mating part which presses the elastic section toward a toe end of said boot by mating with said elastic section when the boots are forwardly tilted.

2. Ski boots as claimed in claim 1 in which a stopper is formed on the shell body to restrict the front cuff from tilting backwardly.

3. Ski boots as claimed in claim 1 in which an ankle tightener is provided on the front cuff to fit the front cuff and the rear cuff by tightening.

4. Ski boots as claimed in claim 1, in which an elastic force-suppressing member is fitted to the oblong hole of the shell body, and an elastic force-adjusting system is provided on the front cuff to adjust an elastic force at the elastic section by sliding said elastic force-suppressing member in the longitudinal direction of said oblong hole.

* * * * *